US008399045B2

(12) United States Patent
Takahashi et al.

(10) Patent No.: US 8,399,045 B2
(45) Date of Patent: Mar. 19, 2013

(54) FILM FORMATION METHOD AND FILM FORMATION APPARATUS

(75) Inventors: Keiichi Takahashi, Hyogo (JP); Shinji Mino, Osaka (JP); Tsunenori Yoshida, Kyoto (JP)

(73) Assignee: Panasonic Corporation, Osaka (JP)

( * ) Notice: Subject to any disclaimer, the term of this patent is extended or adjusted under 35 U.S.C. 154(b) by 439 days.

(21) Appl. No.: 12/673,907

(22) PCT Filed: Jul. 22, 2008

(86) PCT No.: PCT/JP2008/001954

§ 371 (c)(1),
(2), (4) Date: Feb. 17, 2010

(87) PCT Pub. No.: WO2009/050835

PCT Pub. Date: Apr. 23, 2009

(65) Prior Publication Data

US 2011/0070359 A1 Mar. 24, 2011

(30) Foreign Application Priority Data

Oct. 16, 2007 (JP) ..... 2007-269182

(51) Int. Cl.
*B05D 1/12* (2006.01)

(52) U.S. Cl. ..... 427/8; 427/180; 427/190; 427/191

(58) Field of Classification Search ..... 427/8, 180, 427/190, 191

See application file for complete search history.

(56) References Cited

U.S. PATENT DOCUMENTS

| | | | | |
|---|---|---|---|---|
| 6,607,597 | B2 * | 8/2003 | Sun et al. | 118/309 |
| 2005/0098103 | A1 | 5/2005 | Miyoshi | |
| 2005/0211162 | A1 | 9/2005 | Osawa | |
| 2007/0204865 | A1 | 9/2007 | Arakawa | |

FOREIGN PATENT DOCUMENTS

| | | |
|---|---|---|
| JP | 06-128728 | 5/1994 |
| JP | 2001-348659 | 12/2001 |
| JP | 2003-313656 | 11/2003 |
| JP | 2004-277852 | 10/2004 |
| JP | 2005-078985 | 3/2005 |
| JP | 2005-305427 | 11/2005 |
| JP | 2006-200013 | 8/2006 |
| JP | 2006-249461 | 9/2006 |
| JP | 2007-146268 | 6/2007 |
| JP | 2007-231390 | 9/2007 |
| JP | 2007-246943 | 9/2007 |

OTHER PUBLICATIONS

Japanese Notice of Reasons for Rejection, w/ English translation thereof, issued in Japanese Patent Application No. JP 2009-537886 dated Feb. 16, 2010.

* cited by examiner

*Primary Examiner* — Frederick Parker

(74) *Attorney, Agent, or Firm* — McDermott Will & Emery LLP

(57) ABSTRACT

A film formation method according to the present invention includes the step of forming a film of material powders 7 by introducing a carrier gas 5 to a first chamber 8 accommodating the material powders 7 intermittently and mixing the material powders 7 and the carrier gas 5 to generate a first aerosol, introducing the first aerosol to a second chamber 9 to generate a second aerosol, and jetting the second aerosol to a third chamber 13 to form a film of the material powders 7.

9 Claims, 8 Drawing Sheets

FILM FORMATION METHOD AND FILM FORMATION APPARATUS

RELATED APPLICATIONS

This application is the U.S. National Phase under 35 U.S.C. §371 of International Application No. PCT/JP2008/001954, filed on Jul. 22, 2008, which in turn claims the benefit of Japanese Application No. 2007-269182, filed on Oct. 16, 2007, the disclosures of which Applications are incorporated by reference herein.

TECHNICAL FIELD

The present invention relates to a film formation method and a film formation apparatus for forming a film on a substrate or the like by an aerosol deposition method.

BACKGROUND ART

Conventionally, an electrode for a lithium ion secondary cell is produced by applying a compound, obtained by dispersing an active material in a solvent together with a binder and a conductive material, on a current collector and then drying the compound. As the ratio of the binder and the conductive material in the electrode is lower, the cell capacitance per unit volume is larger and thus a higher capacitance cell is obtained. Therefore, it has been studied to produce an electrode without using a binder.

As an example of a method for producing an electrode without using a binder, it has been proposed to use an aerosol deposition method (hereinafter, referred to simply as an "AD method") to produce an electrode for a lithium ion secondary cell. Herein, "aerosol" means microparticles of a solid or a liquid floating in a gas. The "AD method" is a film formation method of generating an aerosol containing particles of a material and jetting the aerosol from a nozzle toward a substrate to deposit the particles. With the AD method, material particles jetted at a high speed collide against the substrate or the material particles already deposited, and a new surface is generated. In addition, the material particles themselves are each crushed at the time of collision, and a new surface is generated on each material particle. By a mechanochemical reaction that such newly generated surfaces adhere to one another, the particles bond to one another and also to the substrate. As a result, a film is formed on the substrate. The AD method is useful as a technology for forming various types of films in addition to an electrode.

With the AD method, the film formation rate varies by various factors such as the concentration and the jetting speed of the aerosol, the scanning rate of the nozzle and the like. It is difficult to keep the film quality constant because the film formation rate is likely to vary, and a film of a desired thickness cannot be formed merely by adjusting the time of film formation. The AD method is a relatively new technology and so how to adjust the film quality and the film thickness has not been sufficiently studied.

Patent Document 1, for example, describes a method called a "gas deposition method" as a film formation method similar to the AD method. The AD method forms an aerosol from powders having a diameter of sub-microns to several microns, carries the aerosol by a carrier gas and forms a film using a mechanochemical reaction, whereas the gas deposition method synthesizes microparticles in a gas phase, carries the microparticles to a substrate by a carrier gas and deposits the microparticles. In general, the microparticles used as a material is generated by vaporizing and then solidifying metal particles.

Patent Document 2, for example, discloses a method for adjusting the thickness of a film formed by the AD method, by which an aerosol containing ceramic particles is generated, the amount of the ceramic microparticles in the aerosol is sensed by a sensor, and the amount is fed back to a control section in a generator.

Patent Document 3 discloses a gas deposition method, by which a part of super-microparticles which have formed an aerosol is introduced to a particle measurement device, either one or both of the particle diameter distribution or the concentration of the super-microparticles are measured by the particle measurement device, and either one or both of the flow rate of the carrier gas and the heating energy are controlled.

Patent Document 4 discloses a gas deposition method, by which particles of a constant quantity are supplied to a space in a second chamber using particle supply means to form an aerosol having a certain particle concentration.

Patent Document 1: Japanese Laid-Open Patent Publication No. 6-128728

Patent Document 2: Japanese Laid-Open Patent Publication No. 2001-348659

Patent Document 3: Japanese Laid-Open Patent Publication No. 2003-313656

Patent Document 4: Japanese Laid-Open Patent Publication No. 2006-200013

DISCLOSURE OF THE INVENTION

Problems to be Solved by the Invention

The average particle diameter of material powders has been conventionally studied, but the coagulation state of the aerosol particles (the state in which the material powders are brought together and present as one body) has not been focused. Films formed using an average particle diameter defined by a conventional method have a variance in film quality, and it is not easy to obtain a fine and high quality film stably.

Meanwhile, when the film formation rate is high, the concentration of the aerosol particles is likely to fluctuate. When the aerosol concentration or any other parameter of the particles is measured in a film formation chamber, powders which did not contribute to the film formation may adhere to the sensor of the film formation chamber and influence the detection result. Therefore, it is difficult to correctly control the film thickness.

The present invention made for solving the above-described problems has an object of providing a film formation method and a film formation apparatus capable of forming a high quality film with a desired thickness at a high film formation rate.

Means for Solving the Problems

A film formation method according to the present invention the step of forming a film of microparticles by introducing a carrier gas to a first chamber accommodating the microparticles intermittently and mixing the microparticles and the carrier gas to generate a first aerosol, introducing the first aerosol to a second chamber to generate a second aerosol; and jetting the second aerosol to a third chamber to form the film of the microparticles.

In one embodiment, the step of forming the film of the microparticles comprises the steps of: (a) measuring at least a concentration of the generated second aerosol and adjusting, based on a result of the measurement, at least one of an amount and a pressure of the carrier gas to be introduced to the first chamber such that the concentration is within a prescribed range; and (b) introducing the carrier gas to the first chamber intermittently with at least one of the adjusted amount and pressure and supplying the second aerosol from the second chamber to the third chamber to jet the second aerosol toward a support installed in the third chamber, thereby forming a film of the microparticles on the support.

In one embodiment, in (a), the measurement and the adjustment are repeated a plurality of times.

In one embodiment, in (a), the concentration and a grain size distribution of the second aerosol are measured.

In one embodiment, a particle measurement section is connected to the second chamber; and the concentration of the second aerosol is obtained by measuring the concentration of the second aerosol introduced to the particle measurement section from the second chamber.

In one embodiment, (a) and (b) are performed alternately by opening alternately a switching valve provided between the second chamber and the particle measurement section and a switching valve provided between the second chamber and the third chamber.

In one embodiment, in (a), the amount or the pressure of the carrier gas to be supplied to the first chamber is changed in accordance with time.

In one embodiment, in (a), the prescribed range of the concentration is determined such that a density of the film of the microparticles has a desired value.

A method for producing an electrode for a nonaqueous electrolytic secondary cell according to the present invention comprises introducing a carrier gas intermittently to a chamber accommodating an active material and mixing the active material and the carrier gas to generate an aerosol, and jetting the aerosol toward a current collector to form an active material layer on the current collector.

In one embodiment, by introducing the carrier gas to the chamber intermittently, the aerosol is intermittently jetted toward the current collector.

A film formation apparatus according to the present invention comprises a first chamber where a carrier gas is introduced from outside intermittently and material powders accommodated inside are mixed with the carrier gas to generate a first aerosol; a second chamber where the first aerosol is introduced from the first chamber to generate a second aerosol; and a third chamber where the second aerosol is introduced from the second chamber and the second aerosol is jetted to a support held inside to form a film of the material powders on the support.

In one embodiment, the film formation apparatus further comprises a particle measurement section to which the second aerosol is introduced from the second chamber, the particle measurement section being for measuring at least a concentration of the second aerosol; and a control section to which a result of the measurement performed by the particle measurement section is output, the control section being for controlling at least one of an amount and a pressure of the carrier gas to be introduced to the first chamber such that the concentration is within a prescribed range.

In one embodiment, the film formation apparatus of further comprises a first path for connecting the second chamber and the particle measurement section to each other; a second path for connecting the second chamber and the third chamber to each other; a first valve provided on the first path for controlling supply of the second aerosol from the second chamber to the particle measurement section; and a second valve provided on the second path for controlling supply of the second aerosol from the second chamber to the third chamber.

In one embodiment, the control section is capable of switching the first valve and the second valve alternately.

In one embodiment, the control section is capable of setting and adjusting a range of the concentration such that a density of the film of the microparticles has a desired value.

Effects of the Invention

According to the present invention, by supplying the carrier gas to the first chamber intermittently, the microparticles can be effectively dispersed in the gas. Therefore, the concentration of the microparticles in the aerosol can be high and stable. Owing to this, a high quality film with little variance in the film quality can be formed at a high film formation rate.

In addition, by providing the second chamber, film formation can be performed with the second aerosol which is more stable than the first aerosol. This can improve the quality and uniformity of the film.

Furthermore, by controlling at least one of the amount and the pressure of the carrier gas to be introduced to the first chamber, the aerosol concentration of the second aerosol can be made closer to a desired value. By finding the aerosol concentration required to obtain the density of a desired value in advance and thus controlling the control section, a film having the density of the desired value can be formed. Since the aerosol concentration of the second aerosol is related to the film formation rate, the control performed by the control section can also adjust the film formation rate.

DESCRIPTION OF THE REFERENCE NUMERALS

| | |
|---|---|
| 1 | Gas cylinder |
| 2a-2d | Pipe |
| 3 | Particle measurement section |
| 4 | Control section |
| 5 | Carrier gas |
| 6a-6c | Control valve |
| 7 | Material powders |
| 8 | First chamber |

-continued

| | |
|---|---|
| 9 | Second chamber |
| 10 | Calculation section |
| 11 | Substrate |
| 12 | Nozzle |
| 13 | Third chamber |
| 15 | Substrate holder |
| 15a | Substrate holder driving section |
| 16 | Exhaust pump |
| 17 | Aerosol |
| 18 | AD film |
| 19 | New surface |
| 20 | Hollow hole |
| 30 | Control mechanism |
| 31 | Gas cylinder |
| 32a-32c | Pipe |
| 33 | Aerosol generator |
| 34 | Film formation chamber |
| 35 | Nozzle |
| 36 | Current collector |
| 37 | Substrate holder |
| 38 | Exhaust pump |
| 39 | Control valve |
| 40 | Active material powders |
| 41 | Positive electrode |
| 41a | Current collector |
| 41b | Active material layer |
| 42 | Negative electrode |
| 42a | Current collector |
| 42b | Active material layer |
| 43 | Separator |
| 44 | Packing case |
| 45 | Positive electrode lead |
| 46 | Negative electrode lead |
| 47 | Resin material |
| 48 | Electrolytic solution |

BEST MODE FOR CARRYING OUT THE INVENTION

Hereinafter, preferable embodiments of the present invention will be described in detail with reference to the figures.

Embodiment 1

Figure 1:
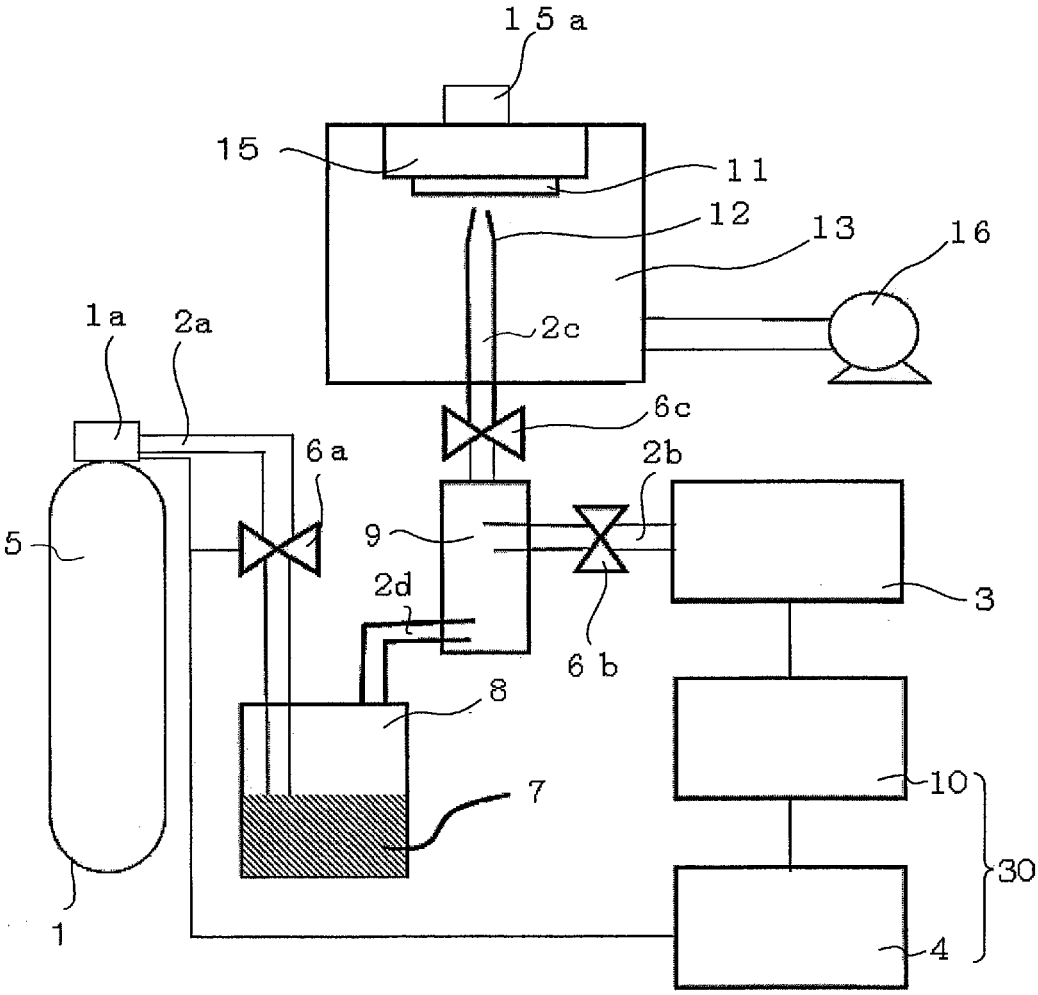
FIG. 1 schematically shows a film formation apparatus in one embodiment of the present invention.

FIG. 1 schematically shows a film formation apparatus in an embodiment according to the present invention. As shown in FIG. 1, the film formation apparatus in this embodiment includes a first chamber 8, a second chamber 9 connected to the first chamber 8, a third chamber 13 connected to the second chamber 9, a particle measurement section 3 connected to the second chamber 9, and a control mechanism 30 connected to the particle measurement section 3.

The first chamber 8 is connected to a gas cylinder 1 via a pipe 2*a*. The gas cylinder 1 is filled with helium used as a carrier gas 5. At a portion at which the gas cylinder 1 is connected to the pipe 2*a*, a pressure adjustment section 1*a* for adjusting a pressure of the carrier gas 5 is provided. The pipe 2*a* is provided with a control valve 6*a* for controlling the supply of the carrier gas 5 from the gas cylinder 1.

The first chamber 8 accommodates material powders 7, and a tip of the pipe 2*a* is inserted into the material powders 7 in the first chamber 8. When the carrier gas 5 is introduced to the first chamber 8 via the pipe 2*a*, the material powders 7 are swirled up and mixed with the carrier gas 5. As a result, a first aerosol is generated. The first chamber 8 may include a vibrating mechanism, a swinging mechanism or a rotating mechanism so as to move the material powders 7 supplied to the inside of the first chamber 8. Such a mechanism keeps the state where the material powders 7 are mixed with the carrier gas 5 by preventing the material powders 7 from coagulating or from being distributed unevenly at the bottom of the container. For example, an ultrasonic vibrator may be used as the vibrating mechanism, and a stirring motor may be used as the rotating mechanism. Aside from the stirring motor, a rotation mechanism for scraping off the material powders 7 from the wall of the container may be provided.

The first chamber 8 and the second chamber 9 are connected to each other via a pipe 2*d*. The first aerosol, when introduced to the second chamber 9 to become a second aerosol. At this point, aerosol particles may be separated as a result of heavy aerosol particles being deposited and lightweight aerosol particles floating. An inner pressure of the second chamber 9 is kept at the atmospheric pressure or the vicinity thereof.

The second chamber 9 and the third chamber 13 are connected to each other via a pipe 2*c*. At a tip of the pipe 2*c*, a nozzle 12 is provided. The pipe 2*c* is provided with a control valve 6*c*. When the control valve 6*c* is opened, the second aerosol is jetted from the nozzle 12 toward a substrate 11 at a high speed. As a result, a film of the material powders 7 is formed on the substrate 11. The nozzle 12 has an opening having a prescribed shape and a prescribed size (e.g., a circular shape having a diameter of 1.0 mm, or a slit shape having a length of 15 mm and a width of 0.2 mm, etc.). The third chamber 13 holds the substrate 11 by a substrate holder 15. The substrate holder 15 is provided with a substrate holder driving section 15*a*. The substrate holder driving section 15*a* controls the relative positions of the nozzle 12 and the substrate 11 and also the relative speed of the substrate 11 with reference to the nozzle 12 three-dimensionally.

The second chamber 9 and the particle measurement section 3 are connected to each other via a pipe 2*b*. The pipe 2*b* is provided with a control valve 6*b*. When the control valve 6*b* is opened, the second aerosol is introduced from the second chamber 9 to the particle measurement section 3. The particle measurement section 3 measures a particle size distribution and a concentration of the second aerosol. The concentration may be measured using a measurement device adopting a system such as a laser scattering method or the like. The particle size distribution may be measured at the same time with the concentration using laser or may be measured separately from the concentration. The particle size distribution may be measured by an electrical mobility classification method, an ultrasonic impactor or the like.

The particle measurement section 3 outputs the measured particle size distribution and concentration to the control mechanism 30. The control mechanism 30 includes a calculation section 10 and a control section 4. The calculation section 10 determines whether the concentration of the second aerosol is within a prescribed range based on the particle size distribution and the concentration of the second aerosol. Based on the calculation results from the calculation section 10, the control section 4 outputs a sensor signal to the control valve 6*a* and the pressure adjustment section 1*a*. The control section 4 controls at least one of an amount and a pressure of the carrier gas to be introduced to the first chamber 8 such that the concentration of the second aerosol measured by the particle measurement section 3 is within the prescribed range. For example, for intermittently supplying the carrier gas 5 to the first chamber 1, the control section 4 opens and closes the control valve 6*a* at an interval of about 10 milliseconds to several minutes.

As the carrier gas 5, it is preferable to use a lightweight gas such as helium in order to increase the speed of supplying the material powders 7 to the third chamber 13 and thus to increase the collision energy on the substrate 11. As the collision energy is larger, a film having a larger bonding force is obtained. In order to further increase the bonding force, it is necessary to break an inactive surface and thus to enlarge an area, in which a new surface can be generated, to the maximum possible degree. The "new surface" means a surface of a highly active state onto which bonding hands of atoms are instantaneously exposed (dangling bond). A new surface is considered to be generated when the collision speed exceeds a certain threshold. As the carrier gas 5, argon, nitrogen, oxygen, dry air or the like may be used as well as helium.

For the material powders 7, any of various materials including metal oxides and non-metal oxides, carbides, nitrides and the like which can be made into a film by an AD method is usable. Usable examples include oxides such as alumina and the like, PZT, composite oxides which form a solid solution with PZT, nitrides such as $Si_3N_4$ and the like, and amorphous powder materials such as $SiO_2$ (x=0.1 to 2) and the like. Usable functional materials include ceramic materials such as $Pb(Mg_{1/3}Nb_{2/3})O_3$, $Pb(Zn_{1/3}Nb_{2/3})O_3$, $Pb(Ni_{1/3}Nb_{2/3})O_3$, $Pb(Mg_{1/3}Nb_{2/3})O_3$, (Mn, Zn)$Fe_2O_3$, $BaTiO_3$, (Li, Na) (Nb, Ta)$O_3$, $LiCoO_3$, Li(Ni, Co, Al)$O_3$, $LaNiO_3$, $Y_3Al_5O_{12}$ and the like. In addition, alloy materials such as CoPtCr are usable.

Figure 2:
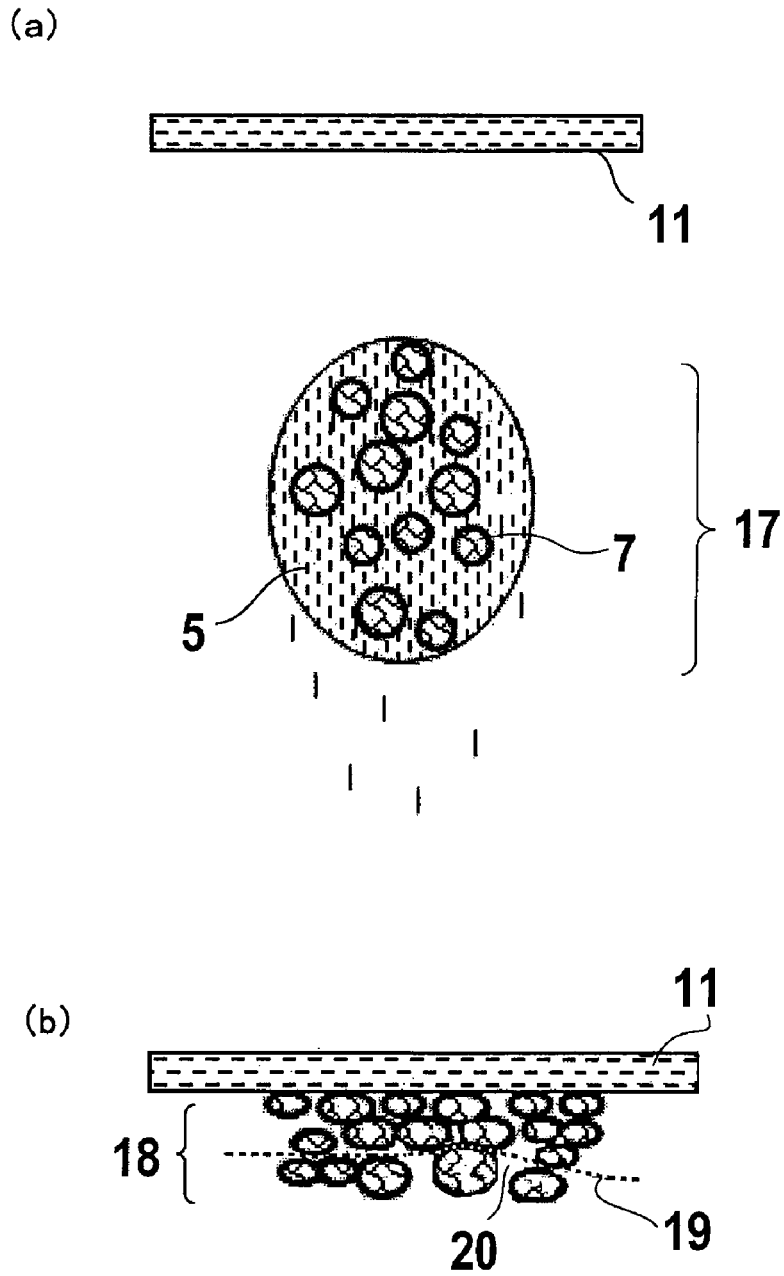
FIGS. 2(*a*) and 2(*b*) are schematic views showing a method for forming a film by an AD method.

FIGS. 2(*a*) and 2(*b*) are schematic views showing a method for producing a film by the AD method (AD film). As shown in FIG. 2(*a*), an aerosol 17 formed of the material powders 7 and the carrier gas 5 is jetted toward a surface of the substrate 11 under the conditions of a vacuum atmosphere and room temperature. As a result, as shown in FIG. 2(*b*), an AD film 18 having the same composition as that of the material powders 7 is formed on the surface of the substrate 11.

When the aerosol 17 collides against the substrate 11, the material powders 7 formed of ceramic particles are broken and deformed, and a new surface 19 to be involved in new bonds (represented by dashed line in FIG. 2(*b*)) is generated. At the same time, a new surface 19 is generated also on the surface of the substrate 11 as a result of an inactive surface being removed. By direct contact of these two new surfaces 19, the particles and the substrate 11 are directly bonded to each other. This bonding is firm even when the AD method is carried out at room temperature. Herein, "direct bonding" means a chemical bond generated at a new surface after an inactive surface layer is removed, and occurs between a material powder 7 and another material powder 7 or between the material powders 7 and atoms at the surface of the substrate 11. When the kinetic energy of collision is small, there are areas in which the new surface is not sufficiently generated and thus the bonding does not occur. In such a case, it is acceptable that one particle has an area where the new surface is generated and an area where the new surface is not generated. When the particles collide against one another, the particles are deformed and broken. These particles are not totally bonded, and a bonding hand may be terminated on the surface without bonding with another particle. An area surrounded by surfaces having such dangling bonds is a hollow hole 20.

The new surface 19 is not sufficiently generated merely by destroying the coagulated particles (a loosely bonded assembly of primary particles or secondary particles, which is unlikely to generate a new surface 19 at the time of when being destroyed). In fact, the new surface 19 is more likely to be generated by breaking sintered secondary particles instead of the coagulated particles. Therefore, it is preferable to use the sintered secondary particles for the material powders 7 in order to form the AD film 18 having a sufficient thickness easily. It is also preferable to use, for the material powders 7, secondary particles having a particle diameter of 0.5 μm or greater and 5 μm or less containing primary particles having a particle diameter of 0.5 μm or less. It is more preferable that the average particle diameter of the primary particles is 0.05 μm or greater and 0.2 μm or less and that the particle diameter of the secondary particles is 1 μm or greater and 3 μm or less.

It is preferable that the average particle diameter of the secondary particles of the material powders 7 is 0.2 μm or greater and 5 μm or less. Where the average particle diameter is within this range, the aerosol 17 is easily obtained, the material powders 7 are easy to bond to one another, and the AD film 18 having a controlled voidage (the porous AD film 18) is obtained. The voidage is the ratio of the hollow holes 20. Especially when the maximum particle diameter of the secondary particles is 15 μm or less, the damage to the substrate 11 is smaller. In the case where the material powders 7 are formed of a lithium-containing composite oxide, the diameter distribution of the secondary particles is preferably 0.5 to 15 μm.

The particle diameter distribution and the average particle diameter of the material particles 7 can be measured by, for example, a wet laser particle size distribution measurement device produced by Micro Track Co., Ltd. In this case, the particle diameter at which the ratio of the accumulated frequency in the particle diameter distribution of the powders is 50% (median value: $D_{50}$) is defined as the average particle diameter.

Figure 3:
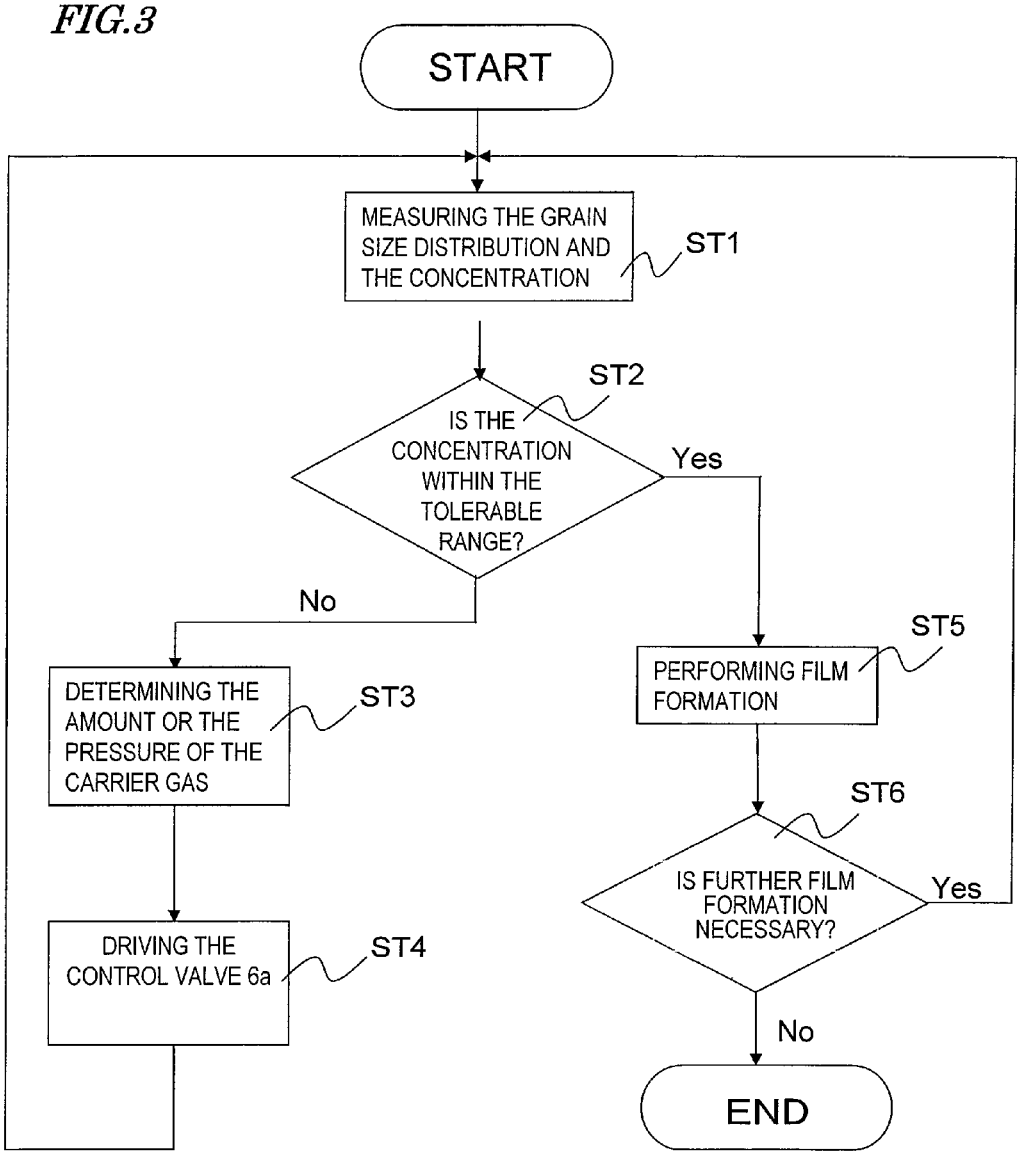
FIG. 3 is a flowchart showing a film formation method in one embodiment of the present invention.

Now, a film formation method in this embodiment will be described with reference to the figures. FIG. 3 is a flowchart showing the film formation method in this embodiment. This film formation method uses the film formation apparatus as shown in FIG. 1 and so will be described also with reference to FIG. 1 again.

According to the film formation method in this embodiment, first, the control valve 6*a* provided on the pipe 2*a* between the gas cylinder 1 and the first chamber 8 is opened to introduce the carrier gas 5 from the gas cylinder 1 to the first chamber 8. When the carrier gas 5 is introduced to the first chamber 8, the material particles 7 accommodated in the first chamber 8 are mixed with the carrier gas 5 to generate the first aerosol. The first aerosol is introduced to the second chamber 9 via the pipe 2*d*, and the second aerosol is generated in the second chamber 9. At this point, the control valve 6*c* provided on the pipe 2*c* is in a closed state and the control valve 6*b* provided on the pipe 2*b* is in an open state. Accordingly, the second aerosol is introduced from the second chamber 9 to the particle measurement section 3.

When the second aerosol is introduced, as shown in step ST1 of FIG. 3, the particle measurement section 3 measures the concentration and the particle size distribution of the second aerosol, and outputs the measurement results to the calculation section 10.

Based on the calculated concentration and particle size distribution, the calculation section 10 performs the following calculations. The particle size distribution and the concentration of the second aerosol are correlated with a density of the film formed at the concentration. Therefore, once the particle size distribution and the concentration are found, the density of the film to be formed can be estimated. In other words, an approximate concentration required for forming a film having a desired density using the aerosol having the measured particle size distribution can be estimated. The calculation section 10 stores the tolerable range of the concentration for each particle size distribution, and based on this, determines whether or not the measured concentration is within the tolerable range (step ST2).

When the measured concentration is outside the tolerable range, the procedure advances to step ST3. In order to put the concentration within the tolerable range, the amount or the pressure of the carrier gas 5 to be introduced to the first chamber 8 is determined. For adjusting the amount of the carrier gas 5, the carrier gas 5 is, for example, supplied intermittently. Specifically, the calculation section 10 calculates a time period in which the control valve 6*a* is to be in an open state (the time period in which the carrier gas 5 is to be supplied to the first chamber 8) and a time period in which the control valve 6*a* is to be in a closed state (the time period in which the supply of the carrier gas 5 to the first chamber 8 is to be stopped). In this embodiment, based on the empirical value of the approximate time interval by which the control valve 6*a* should be opened and closed in order to put the concentration measured by the particle measurement section 3 within the tolerable range, the time period in which the control valve 6*a* is to be in an open state and the time period in which the control valve 6*a* is to be in a closed state are calculated. Such an empirical value may be a value pre-stored on the calculation section 10 or may be a value from the start of operation of the film formation apparatus until the current time. The time periods in which the control valve 6*a* is to be in an open state and in a closed state are output to the control section 4. In step ST4, based on the results, the control section 4 controls the control valve 6*a* to open or close.

For adjusting the pressure of the carrier gas 5 in step ST3, for example, a necessary pressure is calculated by the calculation section 10 and the results are output to the control section 4. Based on the results, the control section 4 controls the pressure adjustment section 1*a*.

When the amount or the pressure of the carrier gas 5 to be introduced to the first chamber 8 is changed, the concentration of the first aerosol generated in the first chamber 8 is also changed. The first aerosol is introduced to the second chamber 9 and the second aerosol is generated. When the second aerosol is introduced to the particle measurement section 3, the particle measurement section 3 measures the concentration again in step ST1. Steps ST1 through ST4 are repeated until this concentration becomes a value within a prescribed range.

When the concentration becomes a value within the prescribed range in step ST2, the procedure advances to step ST5 without changing the amount or the pressure of the carrier gas 5. The carrier gas 5 is introduced from the gas cylinder 1 to the first chamber 8. At the same time, the control valve 6*b* is closed and the control valve 6*c* is opened. The first aerosol generated in the first chamber 8 is introduced to the second chamber 9 to become the second aerosol. Since the control valve 6*b* is in a closed state and the control valve 6*c* is in an open state, the second aerosol is supplied to the third chamber 13. The second aerosol is jetted toward the substrate 11 which is installed in the third chamber 13 and thus a film of the material powders 7 is formed on the substrate 11.

This film formation is performed by supplying the second aerosol from the nozzle 12 while moving the substrate 11. By moving the substrate 11, the nozzle 12 is caused to scan the surface of the substrate 11 in an X-Y direction and finally a film having a desired area size is formed. Specifically, the nozzle 12 is fixed in the X direction and caused to make a scan in the Y direction at a constant speed. When a scan of one line is finished, the nozzle 12 is moved in the X direction in consideration of an overlap with the area in which the film has already been formed, and is caused to make a scan in the Y direction similarly. Thus, the scan in the Y direction is repeated until the nozzle 12 reaches a desired position in the X direction. In this manner, the film having a desired area size is formed.

When the film formation in one area is finished in step ST5, the procedure advances to step ST6. It is preferable that the area in which the film is formed by carrying out step ST5 once is within an area in which the conditions set in step ST4 are not much varied and a film having a desired density is obtained. For example, the nozzle may be caused to scan one line in the Y direction and then advance to step ST6. In step ST6, it is determined whether or not further film formation is necessary. When further film formation is necessary, the procedure returns to step ST1, and steps ST1 through ST4 are repeated. When further film formation is not necessary, the procedure is finished.

In the above description, the calculation section stores the tolerable range of the concentration. Alternatively, the calculation section 10 may store the correlation between the concentration of the second aerosol for each particle size distribution and the density of the film formed at the concentration. In this case, based on the correlation, the density at which the particle size distribution and the concentration measured in step ST2 are obtained is estimated. When this density is outside a prescribed range, a concentration at which a density within the prescribed range is estimated to be obtained is calculated based on the correlation. In this case, the calculation section 10 determines whether or not the density is within the prescribed range. Nonetheless, since the density is correlated with the concentration, the calculation section 10 substantially determines whether or not the concentration is within the prescribed range.

In the above description, the calculation section 10 sets the particle size distribution and the concentration in order to realize a desired density. The particle size distribution and the concentration influence the film formation rate. Therefore, the film formation rate can be made closer to a desired value by adjusting the particle size distribution and the concentration.

In the above description, after the particle measurement section 3 measures the particle size distribution and the concentration, the control mechanism 30 automatically adjusts the amount or the pressure of the carrier gas 5. Alternatively, according to the film formation method in this embodiment, after the particle measurement section 3 measures the particle size distribution and the concentration, the amount or the pressure of the carrier gas 5 may be adjusted manually based on the results of the measurement.

As described above, in this embodiment, the aerosol concentration of the second aerosol can be made closer to a desired value. The aerosol concentration of the second aerosol is correlated with the density of the film of the material powders 7 formed in the third chamber 13 and the film formation rate. Therefore, by finding the aerosol concentration required to obtain the density of the desired value and the desired film formation rate is found in advance, a film of the desired density can be formed by the control of the control mechanism 30.

Even where the amount of the first aerosol generated in the first chamber 8 is varied, the amount of the second aerosol supplied to the third chamber 13 can be stabilized by supplying the first aerosol to the second chamber 9 and keeping the second aerosol for a prescribed time period. In the second chamber 9, for example, heavy material particles can be precipitated. This can reduce the heaviness variance of the material particles (classification effect). Accordingly, the film formation of the second aerosol can be performed under more stable conditions. This can improve the quality and uniformity of the film.

The second chamber 9 is connected to the particle size measurement section 3, and the particle size measurement section 3 measures the concentration and the like of the aerosol. In the particle size measurement section 3, the aerosol particles are not deposited as much as in the second chamber 9 or in the third chamber 13. Therefore, even when some time passes after the start of the measurement of the concentration or the like, the measuring precision can be kept high.

Embodiment 2

Figure 4:
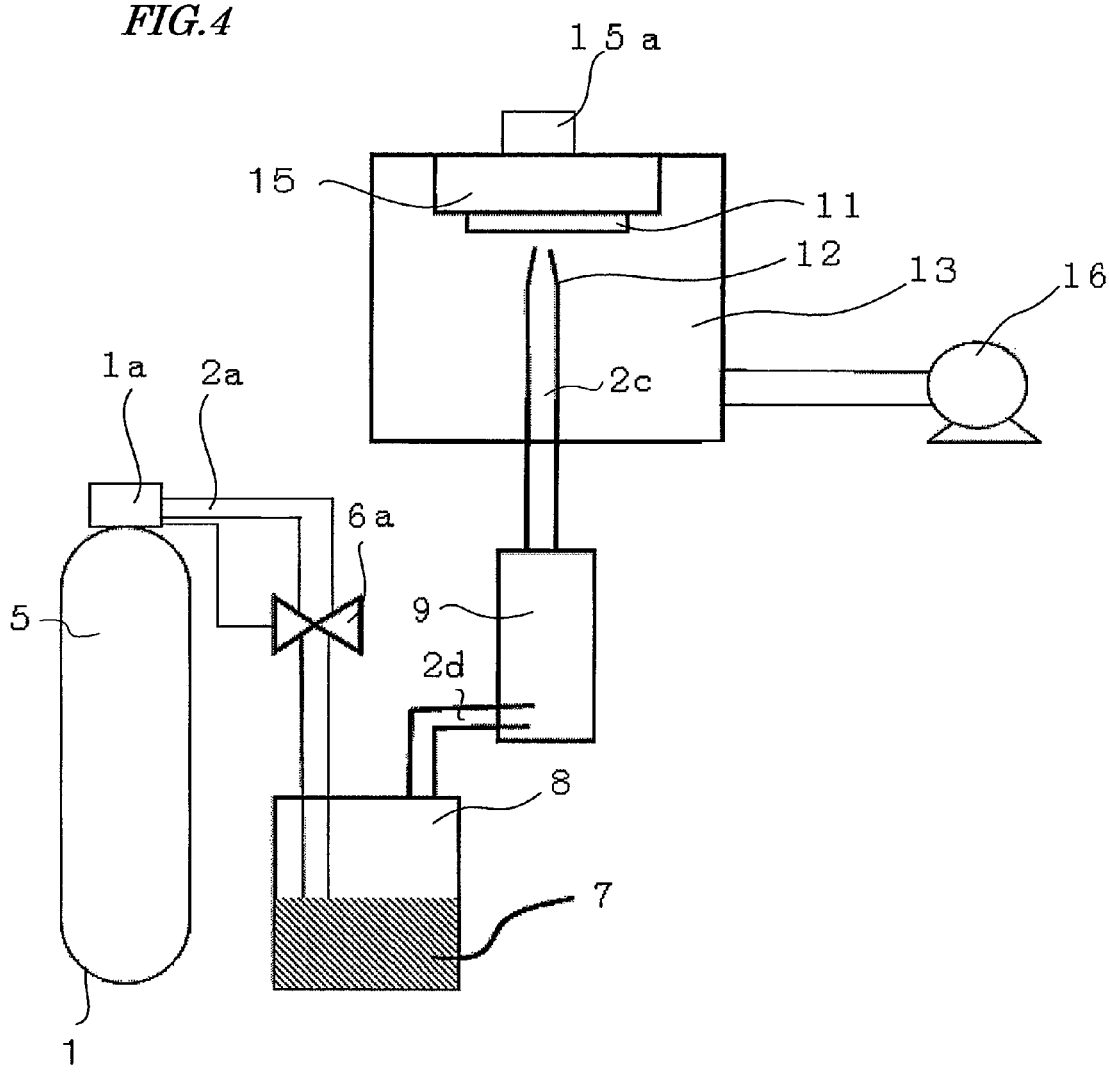
FIG. 4 schematically shows a film formation apparatus in one embodiment of the present invention.

FIG. 4 schematically shows a film formation apparatus in an embodiment according to the present invention. In FIG. 4, identical elements as those in FIG. 1 bear identical reference numerals therewith. Unlike the film formation apparatus shown in FIG. 1, the film formation apparatus shown in FIG. 4 includes none of the particle measurement section 3, the control mechanism 30, the pipe 2*b*, and the nozzles 6*b* and 6*c*.

Hereinafter, a film formation method in this embodiment will be described with reference to FIG. 4.

According to the film formation method in this embodiment, first, the control valve 6*a* is opened and closed repeatedly at the cycle of a constant period to introduce the carrier gas 5 from the gas cylinder 1 to the first chamber 8 intermittently. When the carrier gas 5 is introduced to the first chamber 8, the material particles 7 accommodated in the first chamber 8 and the carrier gas 5 are mixed together to generate first aerosol. The first aerosol is introduced to the second chamber 9 via the pipe 2*d*. In the second chamber 9, a second aerosol is generated. In this embodiment, the time interval for opening and closing the control valve 6*a* is preset. The time interval may be constant or varied.

The second aerosol generated in the second chamber 9 is jetted toward the substrate 11 in the third chamber 13 via the pipe 2*c*. The second aerosol is supplied to the third chamber 13 intermittently at the timing at which the carrier gas 5 is supplied to the first chamber 8. As a result, a film of the material powders 7 is formed on the surface of the substrate 11.

According to the film formation method in this embodiment, the film formation may be started, after the supply of the carrier gas 5 is started and then the concentration or the particle size distribution is measured. In this case, the second chamber 9 may be connected to the particle size measurement section 3 as in FIG. 1 and the second aerosol may be introduced to the particle size measurement section 3 to measure the concentration or the particle size distribution.

According to a conventional method of supplying a carrier gas to an aerosol generator continuously, when the time passes, a majority of the material powders is unevenly distributed and thus is unlikely to be swirled up into the aerosol generator. For this reason, the material particles are unlikely to be dispersed in the aerosol newly generated. This causes the problem that a highly concentrated, a stable aerosol is unlikely to be obtained, and as the film formation rate is decreased, a film having a stable quality is unlikely to be obtained. By contrast, in this embodiment, the carrier gas 5 is supplied to the aerosol generator 13 intermittently, so that the material particles 7 can be effectively dispersed in the gas. Therefore, the concentration of the material particles 7 in the aerosol can be high and stable. Owing to this, in this embodiment, a high quality film with little variance in the film quality can be obtained at a high film formation rate.

In addition, in this embodiment, the aerosol is jetted toward the substrate 11 intermittently. Therefore, as compared to the case where the aerosol is jetted continuously, the density of the film can be decreased appropriately. This can avoid the substrate 11 from being deformed or from having wrinkles or through-holes formed therein. In this embodiment, since the damage to the substrate 11 is small, a metal foil having a small thickness is usable as the substrate 11, and the material powders 7 having a large particle diameter are usable. This eliminates the need to pulverize the material powders 7 for the purpose of alleviating the impact to the substrate 11 unlike the conventional method, and thus allows a film having a high energy density per volume to be produced.

In addition, even where the amount of the first aerosol generated in the first chamber 8 is varied, the amount of the second aerosol supplied to the third chamber 13 can be stabilized by supplying the first aerosol to the second chamber 9 and keeping the second aerosol for a prescribed time period. In the second chamber 9, heavy material particles can be precipitated. This can reduce the heaviness variance of the material particles (classification effect). Accordingly, the film formation of the second aerosol can be performed under more stable conditions. This can improve the quality and uniformity of the film.

REFERENCE EMBODIMENT

Hereinafter, a method for producing an electrode for a nonaqueous electrolytic secondary cell in an embodiment according to the present invention will be described. In this embodiment, a method for producing an active layer of an electrode for a lithium ion secondary cell will be described. The method in this embodiment is carried out using a film formation apparatus as shown in FIG. 5.

Figure 5:
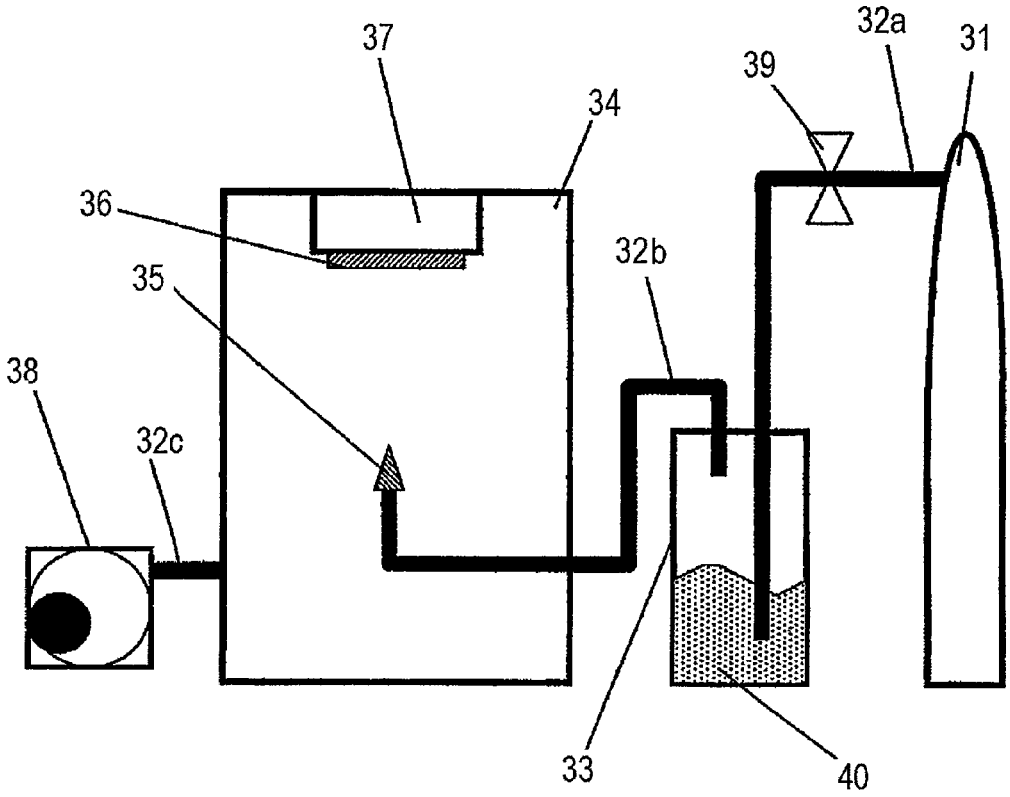
FIG. 5 schematically shows a structure of a film formation apparatus used for a production method in Embodiment 3.

In the film formation apparatus shown in FIG. 5, a gas cylinder 31 stores a carrier gas for generating an aerosol. The gas cylinder 31 is connected to an aerosol generator 33 via a pipe 32*a*, and the pipe 32*a* is drawn to the inside of the aerosol generator 33. Inside the aerosol generator 33, a certain amount of active material powders 40 is put in advance. Another pipe 32*b* connected to the aerosol generator 33 is connected to a film formation chamber 34, and an end of the pipe 32*b* is connected to a nozzle 35 in the film formation chamber 34.

In the film formation chamber 34, a substrate holder 37 holds a current collector 36 as a substrate. The current collector 36 is located to face the nozzle 35. The film formation chamber 34 is connected to an exhaust pump 38, for adjusting the vacuum degree of the inside of the film formation chamber 34, via a pipe 32*c*.

Although not shown, the film formation apparatus used in this embodiment includes a mechanism for moving the substrate holder 37 in a lateral direction or a longitudinal direction (the lateral direction or the longitudinal direction of a plane of the substrate holder 37 facing the nozzle 35) at a certain speed. By performing the film formation while moving the substrate holder 37 in the longitudinal direction and the lateral direction, an active material layer having a desired area size can be formed on the current collector 36.

In the middle of the pipe 32*a* for connecting the gas cylinder 31 and the aerosol generator 33, a control valve 39 is provided. By, for example, opening and closing the control valve 39 alternately, the carrier gas can be supplied from the gas cylinder 31 to the aerosol generator 33 intermittently. The opening/closing operation of the control valve 39 can be controlled by, for example, a control device (not shown) such as a computer or the like.

According to the production method in this embodiment, first, the control valve 39 is opened to introduce the carrier gas in the gas cylinder 31 to the aerosol generator 33 via the pipe 32*a*. When the carrier gas is introduced to the aerosol generator 33, the active material powders 40 are swirled up, and an aerosol having the active material particles dispersed therein is generated in the carrier gas. At this point, the inner pressure of the film formation chamber 34 is low. Therefore, the aerosol generated in the aerosol generator 33 is jetted from the nozzle 35 via the pipe 32*b* at a high speed. Since the nozzle faces the substrate holder 37, the aerosol is jetted toward the current collector 36 held on the substrate holder 37.

The jetting speed of the aerosol is controlled by the shape of the nozzle 35, the length and the inner diameter of the pipe 32*b*, the inner gas pressure of the gas cylinder 31, the exhaust amount of the exhaust pump 38 (the inner pressure of the film formation chamber 34) and the like. For example, where the inner pressure of the aerosol generator 33 is several tens of thousands of Pascals, the inner pressure of the film formation chamber 34 is several hundred Pascals, and the shape of the opening of the nozzle 35 is a circle having an inner diameter of 1 mm, the jetting speed of the aerosol can be made several hundred meters per second by the inner pressure difference between the aerosol generator 33 and the film formation chamber 34.

The active material particles in the aerosol which have obtained a kinetic energy by being accelerated collide against the current collector 36 and are crushed into tiny particles by the collision energy. These crushed particles are bonded to the current collector 36 and also to one another. As a result, a fine active material layer is formed.

Then, the control valve 39 is closed to stop the supply of the carrier gas from the gas cylinder 31 to the aerosol generator 33. After a certain time passes, the valve 39 is opened again. By opening and closing the valve 39 repeatedly in this manner, the carrier gas can be supplied to the aerosol generator 33 intermittently.

In the case where a positive electrode is produced using a metal foil having a thickness of about 20 μm as the current collector 36 and using particles of a lithium-containing composite oxide having an average particle diameter of about 10 μm for the active material powders 40, the film formation conditions may be, for example, as follows: the inner pressure of the film formation chamber 34 is 5 to 5000 Pa, the time period in which the control valve 39 is in an open state is 0.5 to 5 seconds, and the time period in which the control valve 39 is in a closed state is 0.6 to 60 seconds.

According to a conventional method of supplying a carrier gas to an aerosol generator continuously, when the time passes, a majority of the material powders is unevenly distributed and thus is unlikely to be swirled up into the aerosol generator. For this reason, the material particles are unlikely to be dispersed in the aerosol newly generated. This causes the problem that a highly concentrated, a stable aerosol is unlikely to be obtained, and as the film formation rate is decreased, a film having a stable quality is unlikely to be obtained. By contrast, in this embodiment, the carrier gas is supplied to the aerosol generator 33 intermittently, so that the active material powders 40 can be effectively dispersed in the gas. Therefore, the concentration of the active material powders 40 in the aerosol can be high and stable. Owing to this, in this embodiment, a high quality film with little variance in the film quality can be obtained at a high film formation rate.

In addition, in this embodiment, the aerosol is jetted toward the current collector 36 intermittently. Therefore, as compared to the case where the aerosol is jetted continuously, the density of the film can be decreased appropriately. This can avoid the current collector 36 from being deformed or from having wrinkles or through-holes formed therein. In this embodiment, since the damage to the current collector 36 is small, a metal foil having a small thickness is usable as the current collector 36, and the active material powders 40 having a large particle diameter are usable. This eliminates the need to pulverize the active material powders 40 for the purpose of alleviating the impact to the current collector 36 unlike the conventional method, and thus allows a film having a high energy density per volume to be produced.

For example, in the case where powders of a lithium-containing composite oxide having an average particle diameter of 10 μm are used for a positive electrode material, a thin aluminum foil having a thickness of up to 5 μm can be used as the current collector 36.

Figure 6:
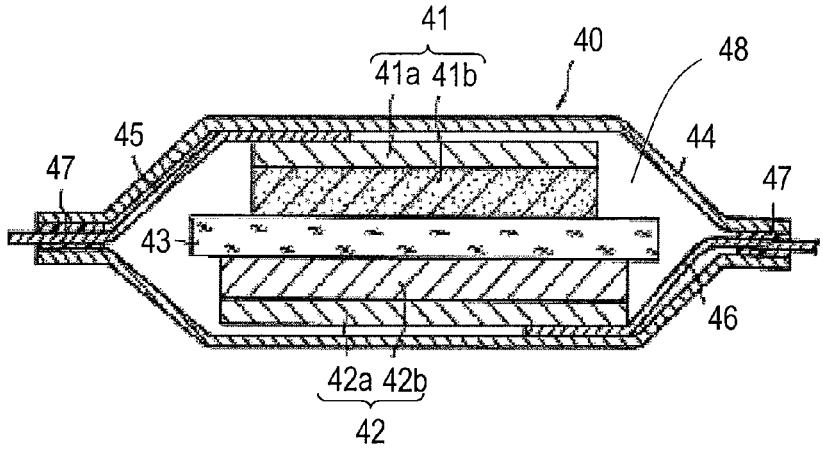
FIG. 6 is a cross-sectional view showing a lithium ion secondary cell using an electrode of Embodiment 3.

Now, with reference to FIG. 6, a structure of a lithium ion secondary cell having an electrode formed by the above-described method will be described. The lithium ion secondary cell shown in FIG. 6 includes a positive electrode 41, a negative electrode 42 facing the positive electrode 41 and provided for occluding and releasing lithium ions, and a separator 43 located between the positive electrode 41 and the negative electrode 42. The positive electrode 41 includes a current collector 41*a* (the current collector 36 shown in FIG. 5) and an active material layer 41*b* formed by the above-described method. The negative electrode 42 includes a current collector 42*a* and an active material layer 42*b*. For the active material layer 42*b* of the negative electrode 42, carbon or an alloy type active material is used. Instead of the positive electrode 41, the negative electrode 42 may be formed by the above-described method.

For a substrate used as the current collector 41*a*, a material containing aluminum as a main component is preferably usable. For example, an aluminum foil is used. The thickness of the substrate may be varied appropriately in accordance with the volume, capacitance and density of the lithium ion secondary cell or the thickness of the active material layer obtained. In general, a commercially available aluminum foil having a thickness in the range of 5 to 20 μm is usable. When the thickness of the aluminum foil is less than 5 μm, the foil is weak and is ruptured or the like at the time of film formation, which decreases the work efficiency. When the thickness of the aluminum foil exceeds 20 μm, the volume, capacitance and density of the lithium ion secondary cell are decreased.

As a material of the active material layer 41*b*, particles of a known lithium-containing composite oxide which allows lithium ions to be inserted thereto or detached therefrom are usable. Usable examples of the lithium-containing composite oxide include lithium cobalt oxide, lithium nickel oxide, lithium manganese oxide, lithium nickel manganese cobalt oxide, lithium nickel cobalt oxide, lithium nickel manganese oxide, lithium nickel cobalt titanium oxide, and such a compound having aluminum added thereto. These compounds may be used independently or as a combination of two or more.

The separator 43 is formed of, for example, a microporous film and contains an electrolytic solution. The positive electrode 41, the negative electrode 42 and the separator 43 are accommodated in a packing case 44, and the packing case 44 is filled with an electrolytic solution 48. Both of two ends of the packing case 44 are sealed with a resin material 47, and a positive electrode lead 45 and a negative electrode lead 46 are respectively fixed thereto with the resin material 47. The positive electrode lead 45 and the negative electrode lead 46 are respectively located between the packing case 44 and the current collector 41*a* and between the packing case 44 and the current collector 42*a* to fix the positive electrode 41 and the negative electrode 42.

As a material of the active material layer 42*b* of the negative electrode 42, any material electrochemically reactive with lithium is usable. An especially preferable material of the active material layer 42*b* of the negative electrode 42 is at least one selected from the group consisting of a single body of silicon, a silicon alloy, a compound containing silicon and oxygen, a compound containing silicon and nitrogen, a single body of tin, a tin alloy, a compound containing tin and oxygen, a compound containing tin and nitrogen, and a carbon-based material. These materials have a property of being relatively highly reactive with lithium and providing a high capacitance.

Examples of the silicon alloy include $SiB_4$, $SiB_6$, $Mg_2Si$, $Ni_2Si$, $TiSi_2$, $MoSi_2$, $CoSi_2$, $NiSi_2$, $CaSi_2$, $CrSi_2$, $Cu_5Si$, $FeSi_2$, $MnSi_2$, $NbSi_2$, $TaSi_2$, $VSi_2$, $WSi_2$, $ZnSi_2$, SiC and the like. Examples of the compound containing silicon and oxygen include $Si_2N_2O$, $SiO_x$ ($0<x\leqq 2$), $SnSiO_3$, LiSiO and the like. Examples of the compound containing silicon and nitrogen include $Si_3N_4$, $Si_2N_2O$ and the like. Examples of the tin alloy include $Mg_2Sn$ and the like. Examples of the alloy containing tin and oxygen include $SnO_x$ ($0<x\leqq 2$), $SnSiO_3$ and the like. Examples of the alloy containing tin and nitrogen include $Sn_3N_4$, $Sn_2N_2O$ and the like. Examples of the carbon-based material include graphite.

As the current collector 42*a* of the negative electrode 42, for example, a copper foil or a nickel foil having a thickness of 5 to 50 μm is usable.

The electrolytic solution (nonaqueous electrolyte) 48 may be anything which is generally usable in a lithium ion secondary cell with no specific limitation. The electrolytic solution 48 is formed of, for example, a nonaqueous solvent and a support salt dissolvable in the nonaqueous solvent. As the nonaqueous solvent, for example, cyclic carbonate such as ethylene carbonate, propylene carbonate or the like is usable. As the support salt, for example, lithium hexafluorophosphate ($LiPF_6$) is usable.

By using the electrode in this embodiment, a lithium ion secondary cell having a large capacitance per volume and having a superb cycle characteristic can be obtained.

Example 1

An AD film was actually produced, and the AD film was used to measure the relationship of the particle diameter and the concentration of the aerosol with respect to the film formation rate and the density of the AD film. Hereinafter, the results will be described.

First, a specific structure of a film formation apparatus used for forming the AD film will be described with reference to FIG. 1 again. As shown in FIG. 1, in the third chamber 13 which is a film formation chamber, the substrate 11 formed of Al and having a thickness of 15 μm is fixed to the substrate holder 15. The inside of the third chamber 13 is kept in a vacuum state by the exhaust pump 16. The nozzle 12 for supplying the aerosol is located to face the surface of the substrate 11. The nozzle 12 has a circular jetting opening having a diameter of 1 mm. The pipe 2*c* connected to the nozzle 12 is drawn to the outside of the film formation chamber 13 and connected to the second chamber 9. In the middle of the pipe 2*c*, the control valve 6*c* for controlling the supply of the aerosol from the second chamber 9 is provided.

The second chamber 9 is cylindrical, and spiral convexed and concaved portions are formed in an inner wall of the cylinder such that a gas stream is directed along the inner wall of the cylinder toward a top jetting opening. On a part of the inner wall of the second chamber 9, a barrier is provided, such that the aerosol flows while rotating in a whirl. In the first chamber 8, the material powders 7 are accommodated, and the concentration of the aerosol is adjusted by changing the amount or the pressure of the carrier gas 5 from the gas cylinder 1. In this example, the amount of the carrier gas 5 per unit time is adjusted by supplying the carrier gas 5 intermittently.

Now, a procedure of the AD method from the generation of the aerosol to the film formation will be described. First, the opening/closing operation of the control valve 6*a* is started to start the intermittent introduction of the carrier gas 5 from the gas cylinder 1 to the first chamber 8. In the first chamber 8, the material powders 7 are accommodated. When the carrier gas 5 is sprayed to the material powders 7, the material powders 7 are swirled up to cause a gas stream stirring state. Thus, a first aerosol containing the material powders 7 and the carrier gas 5 in a mixed state is generated. The first aerosol is introduced to the second chamber 9 via the pipe 2*d* to become a second aerosol. By opening the control valve 6*b* to the particle measurement section 3 and closing the control valve 6*c* to the third chamber 13 in advance, the second aerosol is introduced from the second chamber 9 to the particle measurement section 3. The particle measurement section 3 includes an aerosol particle diameter analyzer Model 3321 produced by TSI, and measures the particle size distribution and the concentration of the aerosol. When the measured concentration is outside the tolerable range, the calculation section 10 calculates an appropriate time period in which the control valve 6*a* is to be in an open state and an appropriate time period in which the control valve 6*a* is to be in a closed state. Namely, the calculation section 10 calculates a time period in which the carrier gas 5 is to be supplied and a time period in which the supply of the carrier gas 5 is to be stopped such that the concentration of the aerosol is within the tolerable range. Based on the calculated time periods, the control section 4 controls the control valve 6*a* to be opened or closed. Until the concentration of the aerosol becomes a value within the tolerable range, the measurement and the control on the control valve 6*a* described above are repeated.

When the concentration of the aerosol becomes a value within the tolerable range, the control valve 6*b* is closed and the control valve 6*c* is opened to send the aerosol to the third chamber 13. The second aerosol is jetted to the substrate 11 via the nozzle 12. As a result of performing such steps, the AD film 18 as shown in FIG. 2(*b*) is formed.

Figure 7:
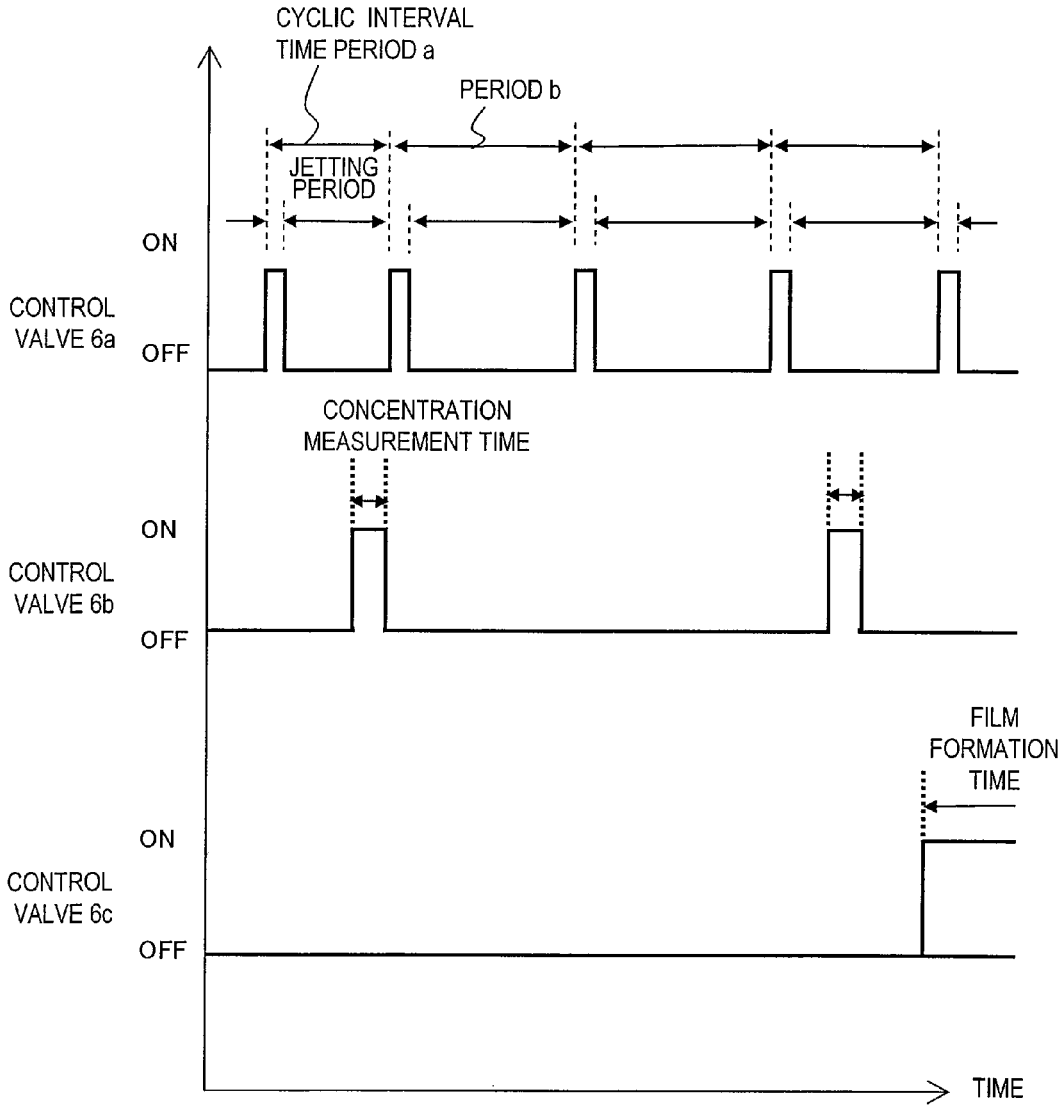
FIG. 7 is a timing diagram showing the timing to open or close control valves 6*a*, 6*b* and 6*c* in Example 1.

FIG. 7 is a timing diagram showing the timing to open or to close the control valves 6*a*, 6*b* and 6*c*. In FIG. 7, the time axis of the timings for the control valves 6*a*, 6*b* and 6*c* is the same. As shown in FIG. 7, first, the control valve 6*a* is controlled to start the intermittent supply of the carrier gas 5. After the particle measurement section 3 measures the concentration of the second aerosol for the first time in the state where the control valve 6*b* is open and the control valve 6*c* is closed, the control valve 6*b* is closed. It is assumed that at this point, the calculation section 10 determines that the concentration as the result of the measurement is outside the tolerable range. In this case, the control section changes the cyclic time period, which is the sum of the time period in which the carrier gas 5 is to be supplied and the time period in which the supply of the carrier gas 5 is to be stopped (cyclic interval time period), from period a to period b. In addition, the control valve 6*b* is opened while the control valve 6*c* is kept closed to measure the concentration for the second time. It is assumed that at this point, the calculation section 10 determines that the concentration as the result of the measurement is within the tolerable range. In this case, the control section 4 opens the control valve 6*c* to start film formation without changing the cyclic interval time period for the carrier gas 5.

In this example, a lithium nickel oxide film was formed as the AD film 18 on an Al foil. For the material powders 7, lithium nickel oxide particles having average particle diameters of 0.55 μm, 1.3 μm and 2.5 μm (produced by Sumitomo Metal Mining Co., Ltd.) were used. The film forming vacuum degree was 200 Pa, the film forming temperature was 30° C., and the carrier gas was helium. The tolerable range of the aerosol concentration was set for each particle size distribution of the material powders 7. In order to realize this range of aerosol concentration, the cyclic interval time period for the introduction of the carrier gas 5 was adjusted in the range of 1 second to 60 seconds. The Al foil as the substrate was moved with respect to the nozzle at a scanning rate of 0.2 mm/sec. to form the film in an area of 6 mm×6 mm.

The film formation rate is represented by the thickness of a film which was formed in an area of 6 mm×6 mm while the substrate was moved with respect to the nozzle at a rate of 0.2 mm/sec. for 1 hour. The film thickness was measured using Surfcom 5000DX produced by Tokyo Seimitsu Co., Ltd. The density of the film was found as follows. A volume of the film was found from a film thickness or another value regarding a shape of the film. The film weight was divided by the volume to find a density, and the density was divided by a theoretical density. From the resultant value, the density of the film was found.

Figure 8:
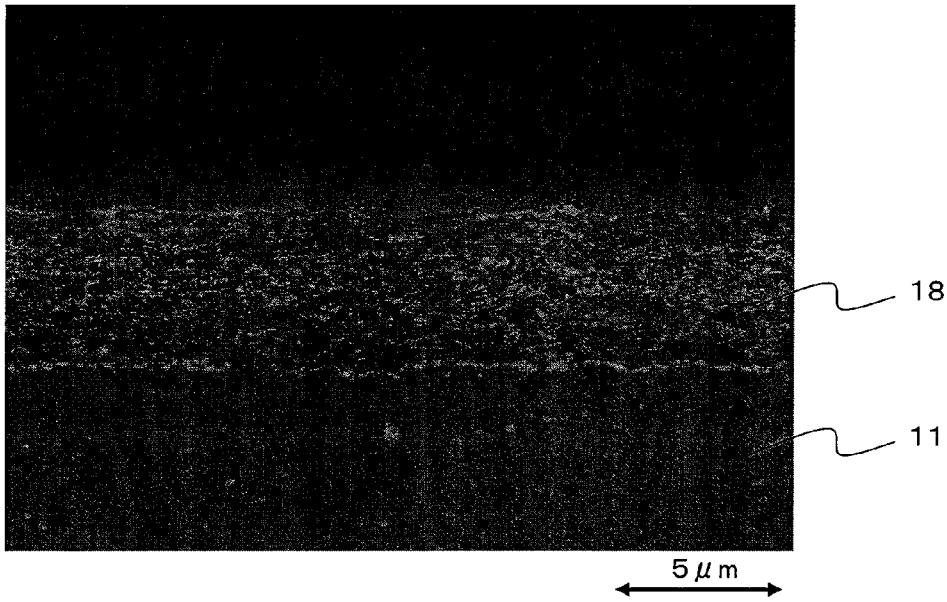
FIG. 8 shows an SEM image of an AD film formed by the film formation apparatus in Embodiment 1.

FIG. 8 shows an SEM image of the AD film produced by the film formation method in this example. The AD film shown in FIG. 8 is a lithium nickel oxide film formed under the conditions that the average particle diameter of the material powders was 1.3 μm and the average cyclic interval time period was 1.2 seconds.

Table 1 shows changes of the aerosol concentration (average value), the film formation rate, and the film density with respect to the change of the cyclic interval time period. As shown in Table 1, the cyclic interval time period, the aerosol concentration, the film formation rate, and the film density were measured for each of the three average particle diameters of the material powders, i.e., 0.55 μm, 1.3 μm and 2.5 μm. By the measurement shown in Table 1, the average particle diameter was measured as one index of the particle size distribution. When the cyclic interval time period was changed, the time period in which the supply of the carrier gas 5 was stopped was changed while the time period in which the carrier gas 5 was supplied was kept the same (1 second). The film formation apparatus in this example fine-tunes the cyclic interval time period by automatically adjusting the time period in which the control valve 6*a* is in a closed state.

TABLE 1

| Material powders | Average particle diameter μm | Cyclic interval time period sec | Aerosol concentration pcs./cm$^3$ | Film formation rate (□6 mm$^2$) μm/h | Film fineness % |
|---|---|---|---|---|---|
| Lithium nickel oxide | 0.55 | 4 | 3890 | 4.9 | 75.6 |
| Lithium nickel oxide | 0.55 | 20 | 3140 | 3.4 | 74.7 |
| Lithium nickel oxide | 0.55 | 58 | 1860 | 2.6 | 70.4 |
| Lithium nickel oxide | 1.3 | 1.2 | 4340 | 5.8 | 90.5 |
| Lithium nickel oxide | 1.3 | 3.6 | 3880 | 4 | 89.8 |
| Lithium nickel oxide | 1.3 | 23 | 3290 | 2.8 | 86.7 |
| Lithium nickel oxide | 2.5 | 2.4 | 5640 | 3.6 | 86.3 |
| Lithium nickel oxide | 2.5 | 12 | 5230 | 2.8 | 85.4 |
| Lithium nickel oxide | 2.5 | 18 | 4780 | 1.5 | 81.9 |

For example, when the average particle diameter of the material powders was 1.3 μm, the sufficiently fine and thick film as shown in FIG. 8 was obtained when the cyclic interval time period was 1.2 seconds. As shown in Table 1, when the average particle diameter is different, the degree of influence exerted by changing the cyclic interval time period is different. Nonetheless, it is seen that with any of the average particle diameters, an extension of the cyclic interval time period decreases the aerosol concentration and also decreases the density. A conceivable reason for this is that as the amount of the carrier gas is larger when the material particles are swirled up, the energy used for destroying the coagulated material powders is larger. It is also seen that a decrease of the aerosol concentration decreases the film formation rate. The relationship of the cyclic interval time period with respect to the film formation rate and the density varies in accordance with the type of the material powders. Depending on the type of the material powders, the film formation rate and the density may be increased when the cyclic interval time period is extended.

From the above-described results of the measurement, it has been found that in order to control the density and the film formation rate of the lithium nickel oxide film to be produced by the AD method, the particle size distribution and the aerosol concentration need to be adjusted.

Example 2

An AD film in Example 2 and an AD film in a comparative example were produced. Hereinafter, the results of comparison of these AD films will be described.

The AD film in Example 2 was produced by supplying the carrier gas 5 to the first chamber 8 using substantially the same film formation apparatus as that used for forming the AD film in Example 1. However, the adjustment on the time period in which the control valve is to be in an open state and the time period in which the control valve is to be in a closed state based on the measurement results of the particle size distribution and the concentration of the aerosol was not performed, and the control valve 6*a* was opened and closed at a preset time interval.

For forming the AD film in the comparative example, a film formation apparatus having the structure shown in FIG. 1 but without the control valve 6*a*, or a film formation apparatus in which the control valve 6*a* is always open, was used. The AD film in the comparative example was produced by supplying the carrier gas to the aerosol generator (second chamber 9) continuously with such a film formation apparatus.

Figure 9:
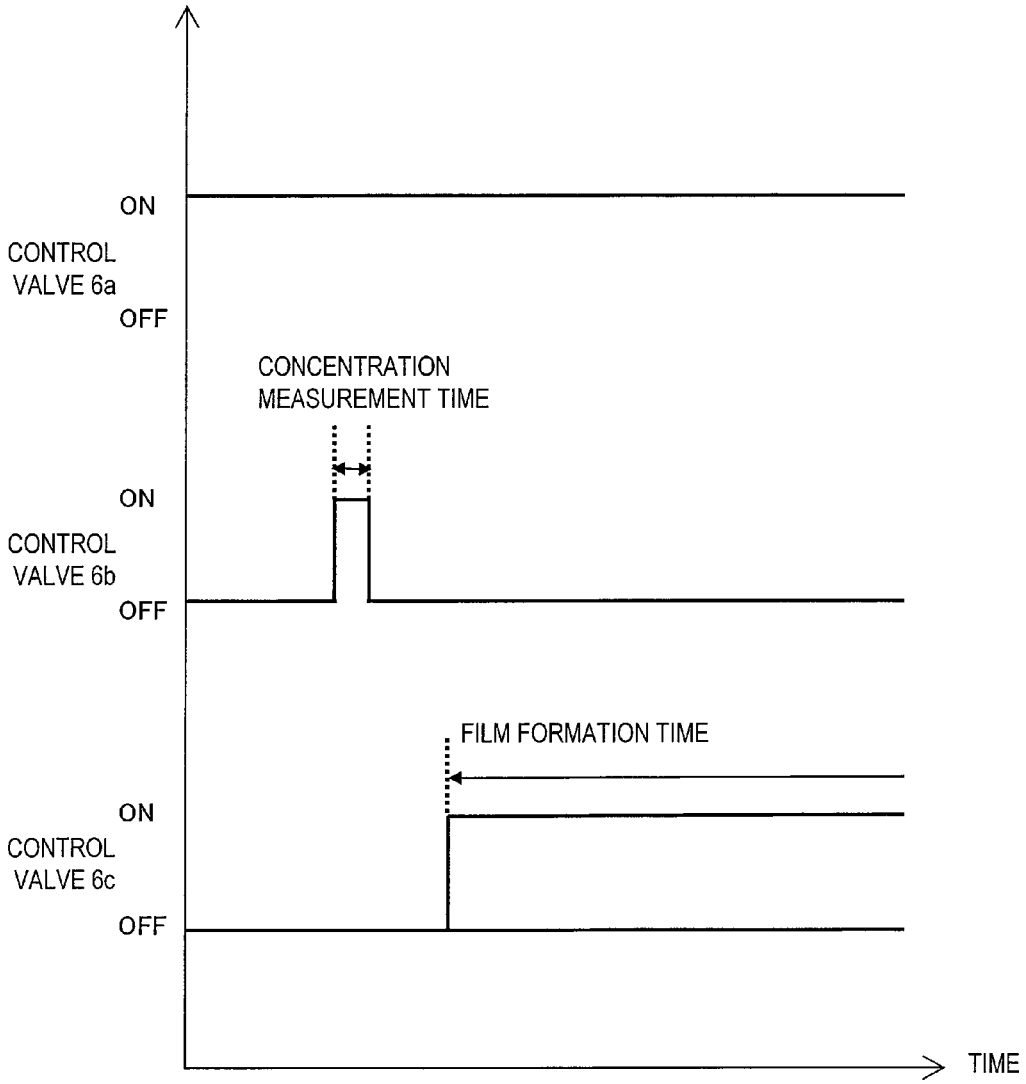
FIG. 9 is a timing diagram showing the timing to open or close control valves 6*a*, 6*b* and 6*c* in a comparative example.

Hereinafter, a procedure for producing the AD film in the comparative example will be specifically described. FIG. 9 is a timing diagram showing the timing to open or to close the control valves 6*a*, 6*b* and 6*c* for forming the AD film in the comparative example. In FIG. 9, the time axis of the timings for the control valves 6*a*, 6*b* and 6*c* is the same.

As in Example 1, the first chamber 8 accommodates the material powders 7. In the first chamber 8, a tip of the pipe 2*a* is buried in the material powders 7. When the carrier gas 5 is sprayed to the material powders 7, the material powders 7 are swirled up to generate a first aerosol containing the material powders 7 and the carrier gas 5 in a mixed state. The first aerosol is introduced to the second chamber 9 via the pipe 2*d* to become a second aerosol. By opening the control valve 6*b* to the particle measurement section 3 in this state as shown in FIG. 9, the second aerosol is introduced to the particle measurement section 3 and the concentration thereof is measured. When the measurement of the concentration is finished, the control valve 6*b* is closed and the control valve 6*c* is opened, so that the second aerosol in the second chamber 9 is sent to the third chamber 13 and the second aerosol is jetted via the nozzle 12. Thus, the AD film is formed on the substrate 11.

As each of the AD film in Example 2 and the AD film in the comparative example, a lithium nickel oxide was formed on an Al foil. For the material powders 7, lithium nickel oxide particles having an average particle diameter of 1.3 μm (produced by Sumitomo Metal Mining Co., Ltd.) were used. The film forming vacuum degree was 200 Pa, the film forming temperature was 30° C., and the carrier gas was helium. The Al foil as the substrate was moved with respect to the nozzle at a scanning rate of 0.2 mm/sec. to form the film in an area of 6 mm×6 mm.

The film formation rate is represented by the thickness of a film which was formed in an area of 6 mm×6 mm while the substrate was moved with respect to the nozzle at a rate of 0.2 mm/sec. for 1 hour. The film thickness was measured using Surfcom 5000DX produced by Tokyo Seimitsu Co., Ltd. The density of the film was found as follows. A volume of the film was found from a film thickness or another value regarding a shape of the film. The film weight was divided by the volume to find a density, and the density was divided by a theoretical density. From the resultant value, the density of the film was found.

Table 2 shows changes of the aerosol concentration, the film formation rate, and the film density when the film formation was performed by supplying the carrier gas intermittently (Example 2) and when the film formation was performed by supplying the carrier gas continuously (comparative example). As shown in Table 2, in Example 2, one sample was produced by supplying the carrier gas and stopping the supply of the carrier gas at a period of 1.2 seconds (supplying the carrier gas for 0.2 seconds and stopping the supply of the carrier gas for 1 second). In the comparative example, three samples were produced by supplying the carrier gas at flow rates of 3 liters/min., 6 liters/min. and 9 liters/min. respectively. The measurement was performed on these samples.

TABLE 2

| Material powders | Average particle diameter μm | Cyclic interval time period sec | Gas flow rate l/min | Average aerosol particle diameter μm | Aerosol concentration pcs./cm$^3$ | Film formation rate (□6 mm$^2$) μm/h | Film fineness % |
|---|---|---|---|---|---|---|---|
| Lithium nickel oxide | 1.3 | 1.2 | 6 | 1.25 | 4340 | 5.8 | 90.5 |
| Lithium nickel oxide | 1.3 | | 3 | 1.3 | 2020 | 1.9 | 92.6 |
| Lithium nickel oxide | 1.3 | | 6 | 1.3 | 2140 | 2.1 | 91.4 |
| Lithium nickel oxide | 1.3 | | 9 | 1.3 | 2360 | 2.2 | 90.9 |

As shown in Table 1, it is seen that when the film formation is performed by introducing the carrier gas continuously, a finer film is obtained but the film formation rate is decreased by the decrease of the aerosol concentration. From the above results, it has been found that in order to improve the film formation rate of the lithium nickel oxide film by the AD method, the aerosol concentration needs to be kept high by introducing the carrier gas intermittently.

INDUSTRIAL APPLICABILITY

The present invention is highly industrially applicable in that a high quality film can be formed at a desired thickness by the AD method.

The invention claimed is:

1. A film formation method comprising steps of:

introducing a carrier gas intermittently to a first chamber accommodating microparticles and mixing the microparticles and the carrier gas to generate a first aerosol;

introducing the first aerosol to a second chamber to generate a second aerosol, the second aerosol being generated by classifying the first aerosol; and jetting the second aerosol intermittently to a support installed in a third chamber to form a film of the microparticles on the support.

2. The film formation method of claim 1, further comprising the steps of:

(a) measuring at least a concentration of the generated second aerosol and adjusting, based on a result of the measurement, at least one of an amount and a pressure of the carrier gas to be introduced to the first chamber such that the concentration is within a prescribed range; and (b) introducing the carrier gas to the first chamber intermittently with at least one of the adjusted amount and pressure and supplying the second aerosol from the second chamber to the third chamber to jet the second aerosol toward the support.

3. The film formation method of claim 2, wherein in step (a), the measurement and the adjustment are repeated a plurality of times.

4. The film formation method of claim 2, wherein in step (a), the concentration and a particle size distribution of the second aerosol are measured.

5. The film formation method of claim 2, wherein:

a particle measurement section is connected to the second chamber; and the concentration of the second aerosol is obtained by measuring the concentration of the second aerosol introduced to the particle measurement section from the second chamber.

6. The film formation method of claim 5, wherein steps (a) and (b) are performed alternately by opening alternately a switching valve provided between the second chamber and the particle measurement section and a switching valve provided between the second chamber and the third chamber.

7. The film formation method of claim 2, wherein in the step (a), the amount or the pressure of the carrier gas to be supplied to the first chamber is changed in accordance with time.

8. The film formation method of claim 2, wherein in the step (a), the prescribed range of the concentration is determined such that a density of the film of the microparticles has a desired value.

9. The film formation method of claim 1, wherein the carrier gas is intermittently introduced to the first chamber with a period of 1 to 60 seconds.

* * * * *